US007823240B2

(12) United States Patent
Chen

(10) Patent No.: US 7,823,240 B2
(45) Date of Patent: Nov. 2, 2010

(54) HOOKED COLLAR FOR PIERS AND BRIDGE INCLUDING THE SAME

(76) Inventor: Su-Chin Chen, No. 250, Kuo-Kuang Rd., Taichung 402 (TW)

( * ) Notice: Subject to any disclaimer, the term of this patent is extended or adjusted under 35 U.S.C. 154(b) by 99 days.

(21) Appl. No.: 12/108,630

(22) Filed: Apr. 24, 2008

(65) Prior Publication Data

US 2009/0269136 A1 Oct. 29, 2009

(51) Int. Cl.
*E01D 19/02* (2006.01)
*E02B 3/02* (2006.01)

(52) U.S. Cl. ..... 14/75; 14/78; 405/76; 405/74; 405/80

(58) Field of Classification Search ..... 14/75, 14/77.3; 405/60, 74, 80, 73
See application file for complete search history.

(56) References Cited

U.S. PATENT DOCUMENTS

| | | | | |
|---|---|---|---|---|
| 48,530 | A * | 7/1865 | Derrom | 14/75 |
| 3,738,113 | A * | 6/1973 | Madary et al. | 405/210 |
| 4,019,332 | A * | 4/1977 | Lamy | 405/211 |
| 4,717,286 | A * | 1/1988 | Loer | 405/74 |
| 5,839,853 | A * | 11/1998 | Oppenheimer et al. | 405/60 |
| 6,186,445 | B1 * | 2/2001 | Batcho | 244/130 |

FOREIGN PATENT DOCUMENTS

KR 2005023378 * 3/2005

* cited by examiner

*Primary Examiner*—Raymond W Addie
(74) *Attorney, Agent, or Firm*—Chun-Ming Shih

(57) ABSTRACT

A bridge includes a pier, and a hooked collar at least formed on upstream surface of the pier. The anti-scour structure includes at least one hook extending upwardly. The hook configured for guiding water flow or downflow to move upwardly thereby protect river bed from being scoured.

9 Claims, 12 Drawing Sheets

HOOKED COLLAR FOR PIERS AND BRIDGE INCLUDING THE SAME

BACKGROUND

The present invention generally relates to a hooked collar, and more particularly to a hooked collar formed on piers for protecting the piers from being scoured.

FIG. 12 illustrates a generally used pier A, water flow B at upstream side is blocked by the pier thereby producing a bow wave B1 on the river surface and a downflow B2 moving downwardly along front side surface of the pier A. The downflow produces a vortex B3 at the river bed C. The vortex B3 scours the river bed. As a result, a scour hole C1 is formed and a caisson foundation A1 of the pier A is uncovered. When the flood scours bottom of the caisson foundation A1, the caisson foundation A1 may cause sink, rupture and evenly collapsing of a bridge.

Therefore, there is a desire to improve such a pier.

BRIEF SUMMARY

A hooked collar which can effectively guide water flow to move upwardly, and protect river bed from being scoured and the caisson from being uncovered is provided. Security of the bridges take uses of such anti-scour structure is improved and people's life and carried wealth can be protected.

In one exemplary embodiment, a hooked collar for pier includes a hook at least formed on upstream surface of the pier and a space of collar raised from the pier. The hook can be disposed at periphery boundary of the space of collar or close to an upper portion of the space of collar. The hooked collar guides water flow or downflow to move upwardly thereby protecting river bed from being scoured.

In another exemplary embodiment, a hooked collar for pier includes a space of collar recessed into the pier and a hook disposed at periphery boundary of the space of collar or close to an upper portion of the space of collar. The hooked collar guides water flow or downflow to move upwardly thereby protecting river bed from being scoured.

In still another exemplary embodiment, a bridge includes a pier, and a hooked collar at least formed on upstream surface of the pier. The anti-scour structure includes at least one hook extending upwardly. The hook configured for guiding water flow or downflow to move upwardly thereby protect river bed from being scoured.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
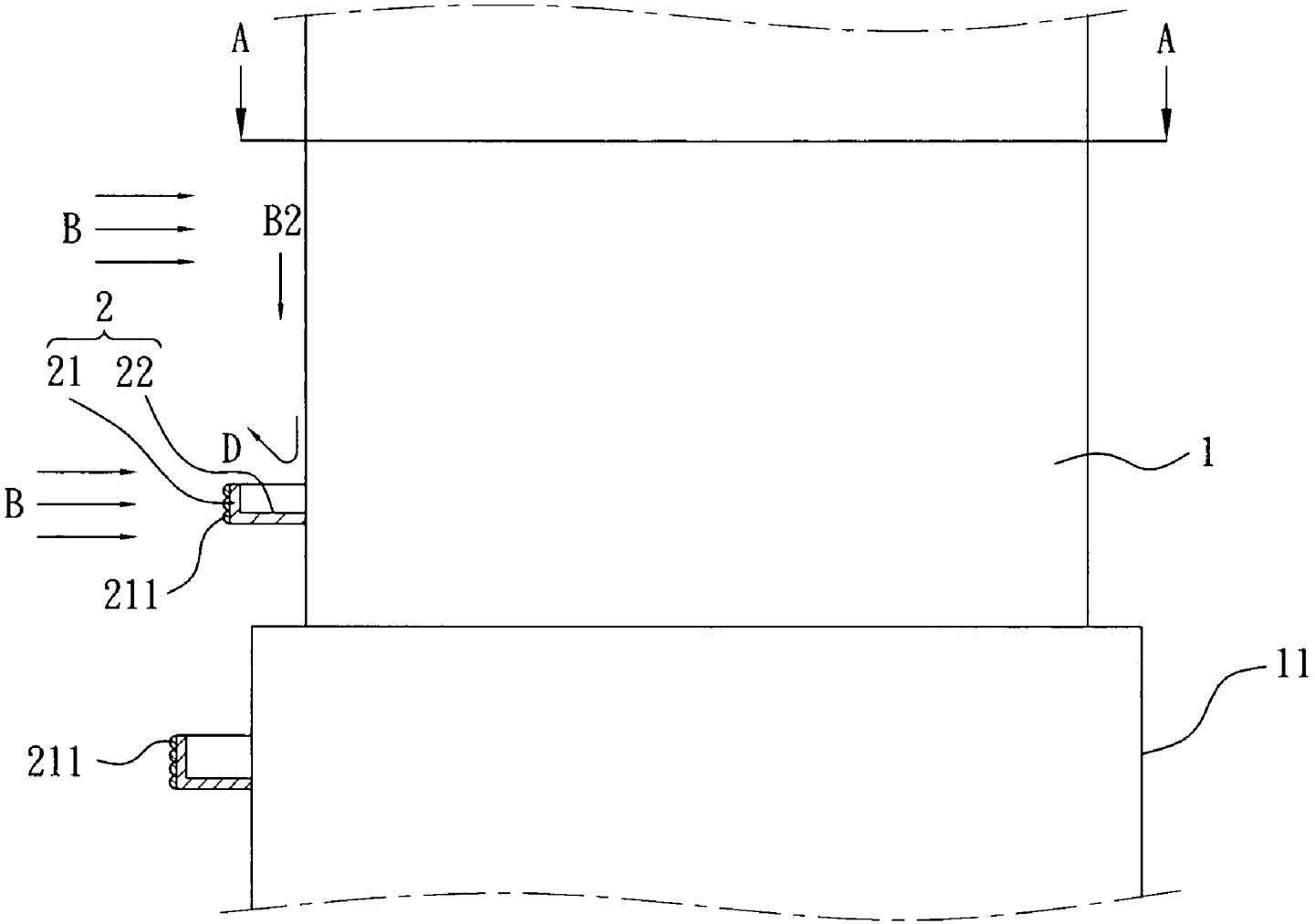
FIG. 1 is side view of a hooked collar in accordance with a first embodiment.
Figure 2:
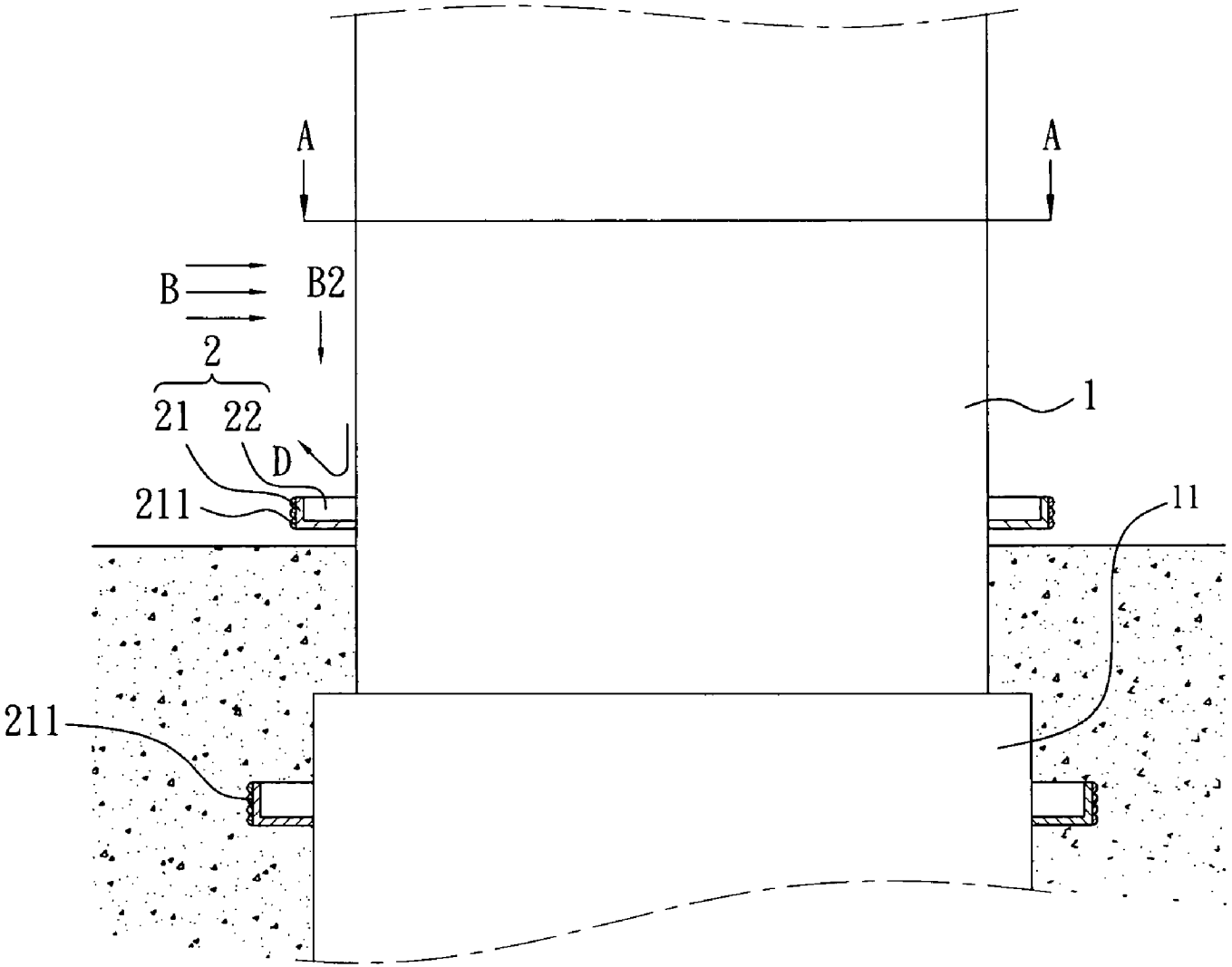
FIG. 2 is a schematic view showing water flow is guided by the hooked collar of the first embodiment.

As shown in FIGS. 1~11, at least one hooked collar is formed on upstream surface of a pier 1 or around the pier 1, or formed on upstream surface of a caisson 11 or around the caisson 11, or both on the pier 1 and the caisson 11. The hooked collar includes at least one hook 21. The hooked collar 2 guides the downflow B2 produced by the flow B to move upwardly, referring to FIGS. 2, 5 and 7; as a result, the river bed is protected from being scoured.

FIGS. 1, 2, 8 and 9 illustrate a hooked collar 2 in accordance with a first embodiment. The hooked collar 2 includes a space of collar 22 raised from the pier 1 or the caisson 11. The hook 21 can be disposed at a periphery boundary of the space of collar 22 or close to an upper portion of the periphery boundary of the space of collar 22. In the present embodiment, the hook 21 perpendicularly extends from the pier 1 at a certain distance (i.e. the width of the space of collar) and then bends to extend upwardly thereby serving as a sidewall of the space of collar 22. The space of collar 22 blocks the downflow B2 and the hook 21 guides the downflow B2 to move upwardly, as shown by a flow direction D in FIGS. 1 and 2, the river bed is protected from being scoured by the downflow B2.

FIGS. 4, 5, 7, 10 and 11 illustrate a hooked collar 2 in accordance with a second embodiment. The hooked collar 2 includes a space of collar 23 recessed into the pier 1 and the caisson 11. The hook 21 can be disposed at a periphery boundary of the space of collar 22 or close to an upper portion of the periphery boundary of the space of collar 22. In the present embodiment, the hook 21 directly extending from the pier 1 or the caisson 11. The hook 21 and the pier 1 (or the caisson 11) cooperatively define the space of collar 23.

Figure 4:
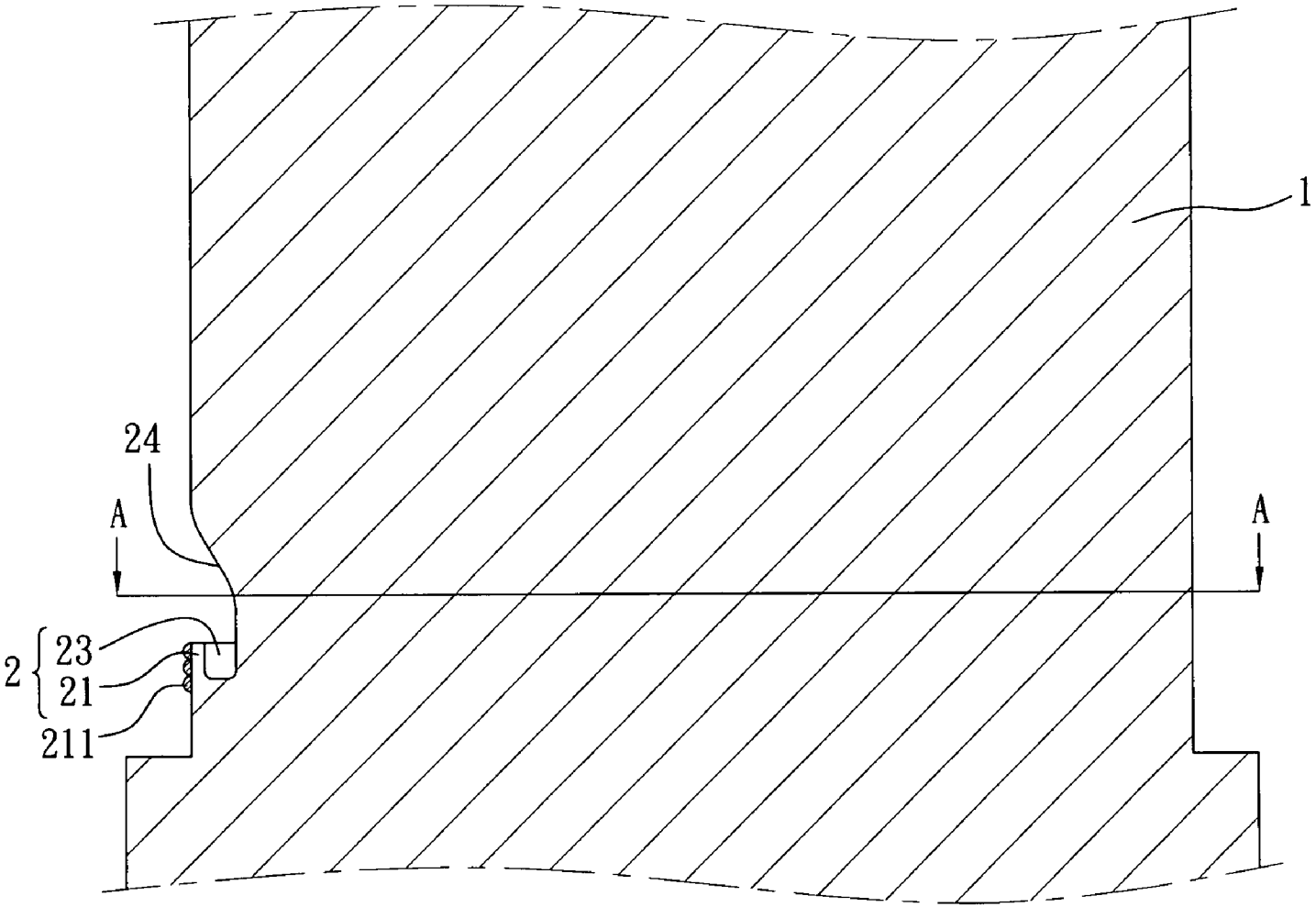
FIG. 4 is side cross sectional view of a hooked collar in accordance with a second embodiment.
Figure 5:
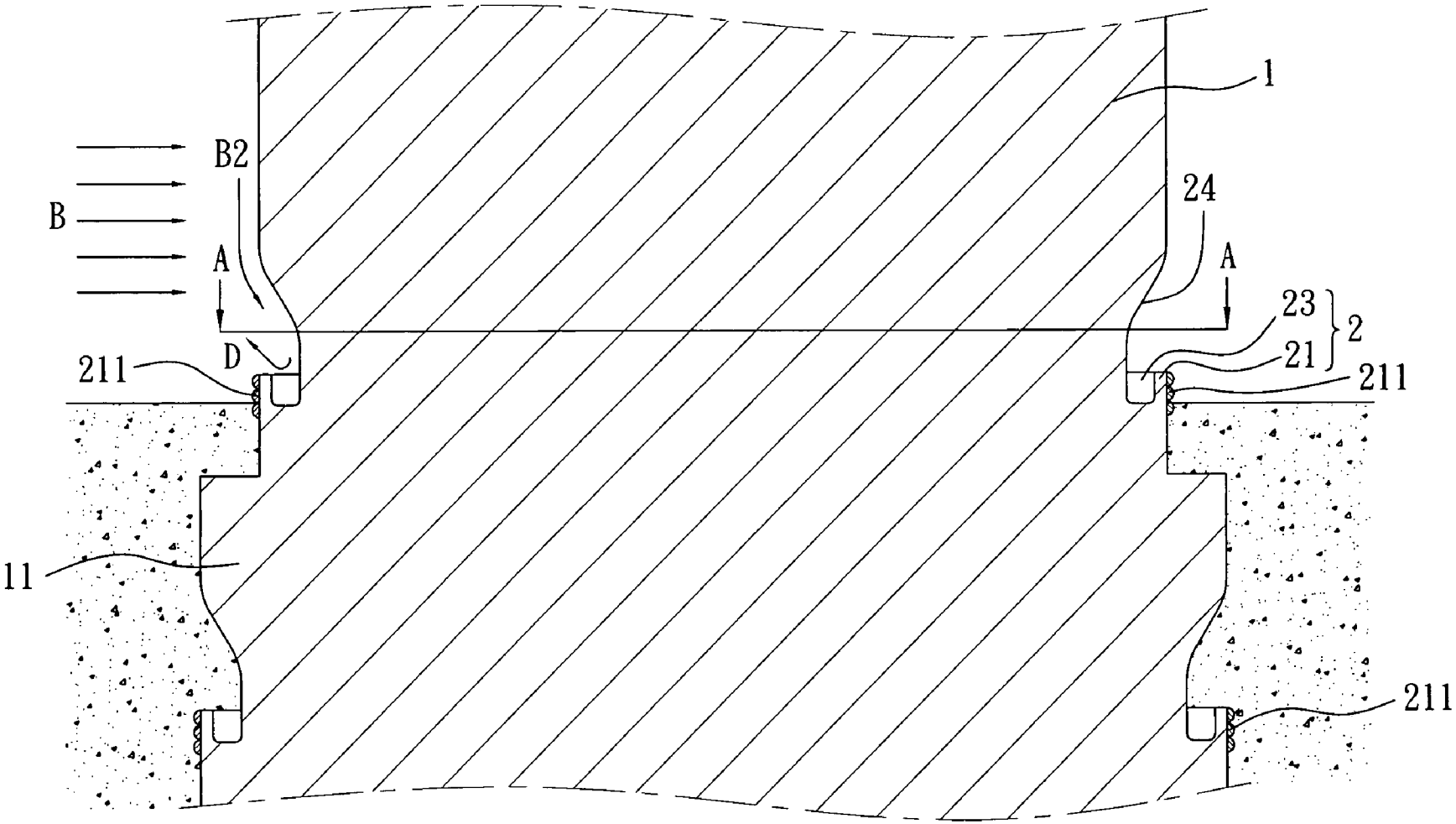
FIG. 5 is a schematic view showing water flow is guided by the hooked collar of the second embodiment.
Figure 6:
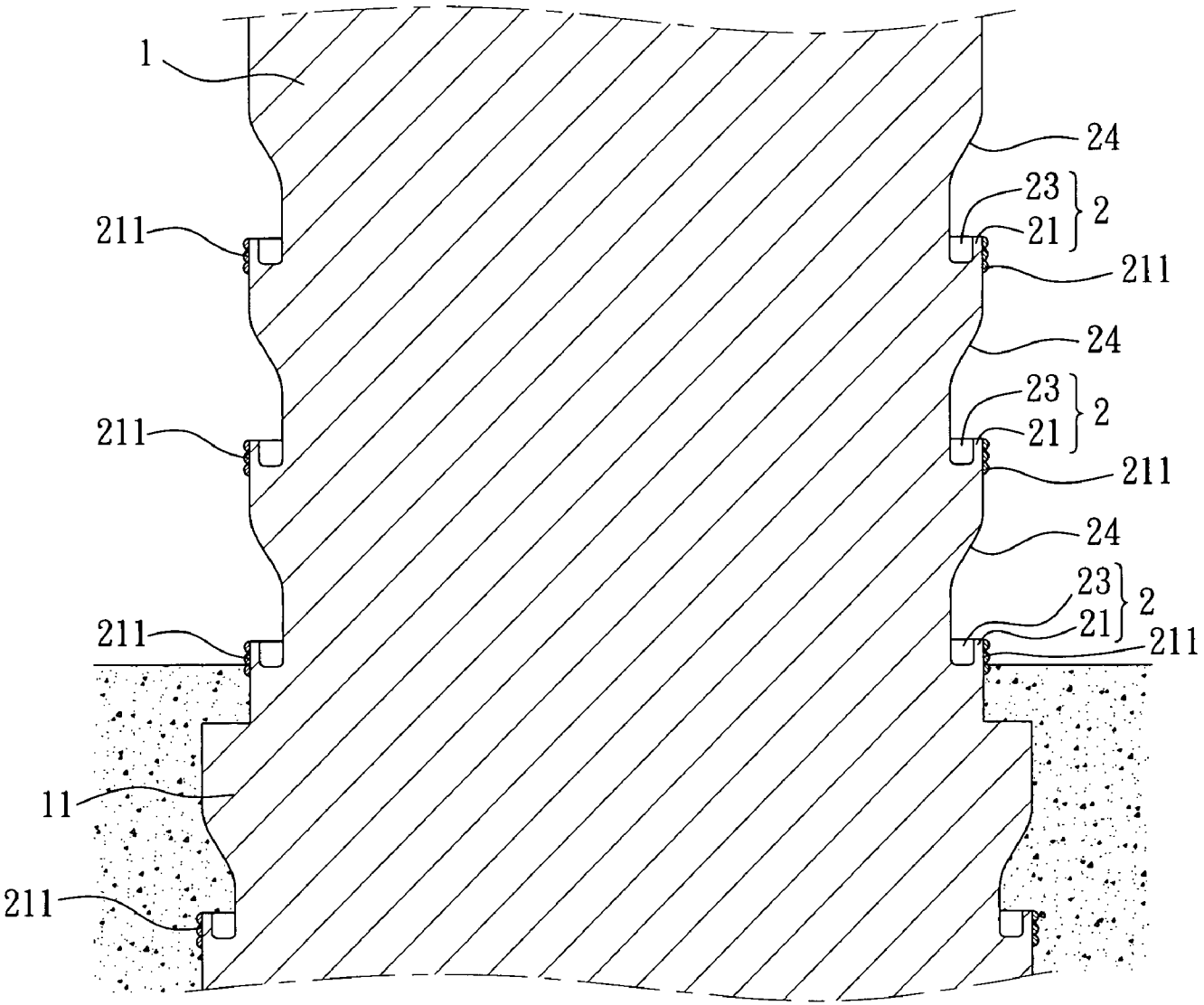
FIG. 6 is a side cross sectional view of the hooked collar of the second embodiment in a multilayer manner.
Figure 7:
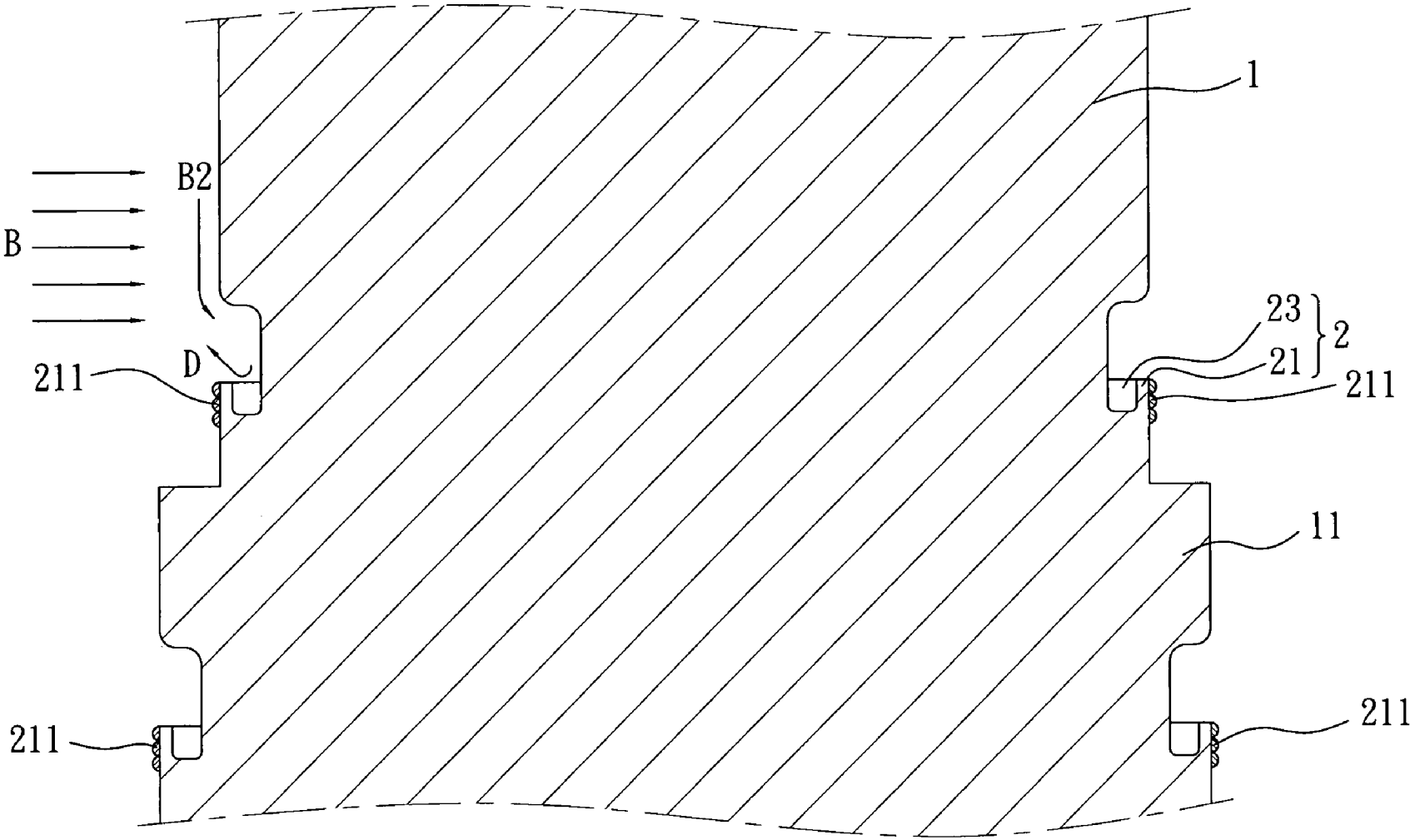
FIG. 7 is an another side cross sectional view of the hooked collar of the second embodiment.
Figure 8:
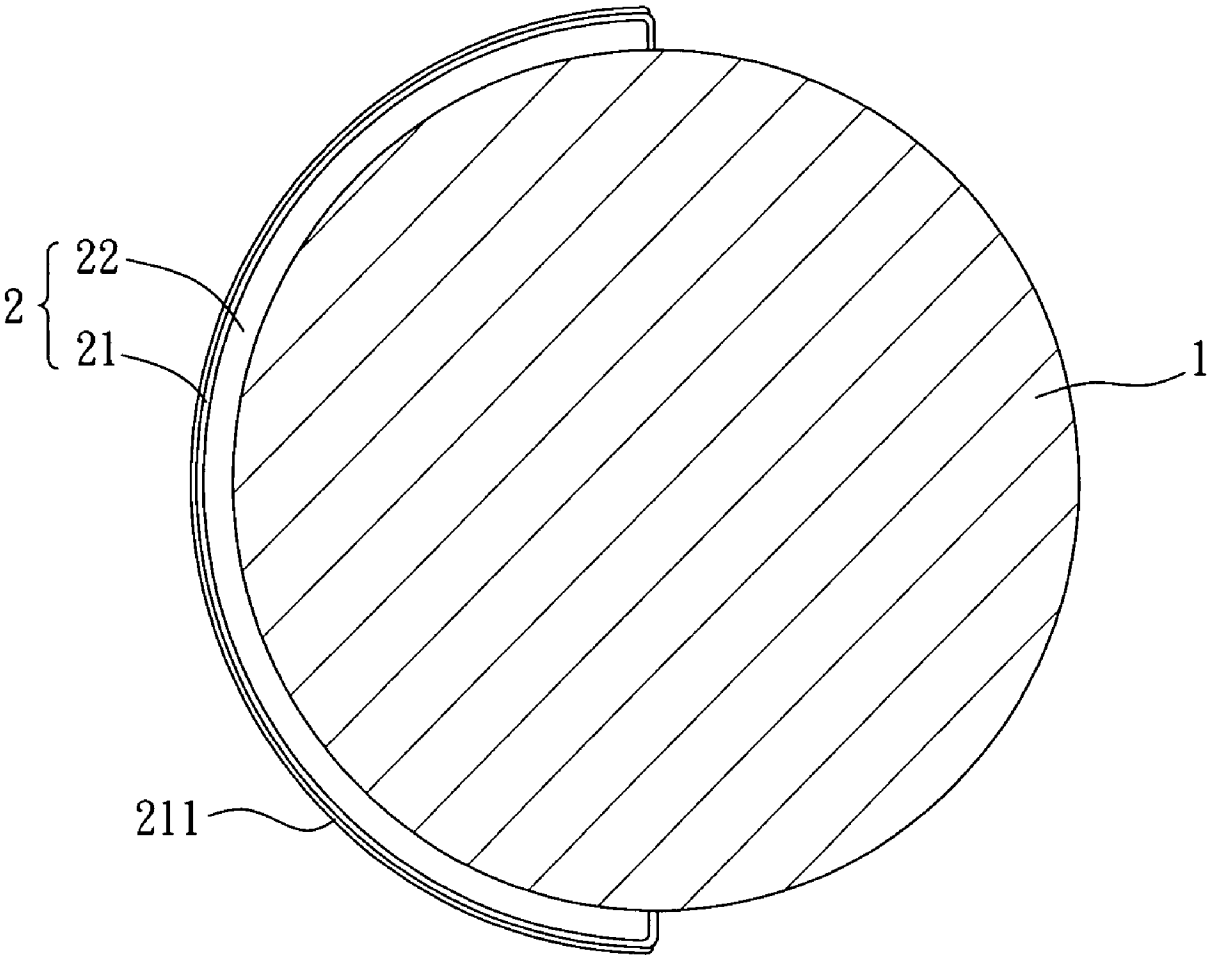
FIG. 8 is a cross sectional view of FIG. 1 along line A-A.
Figure 9:
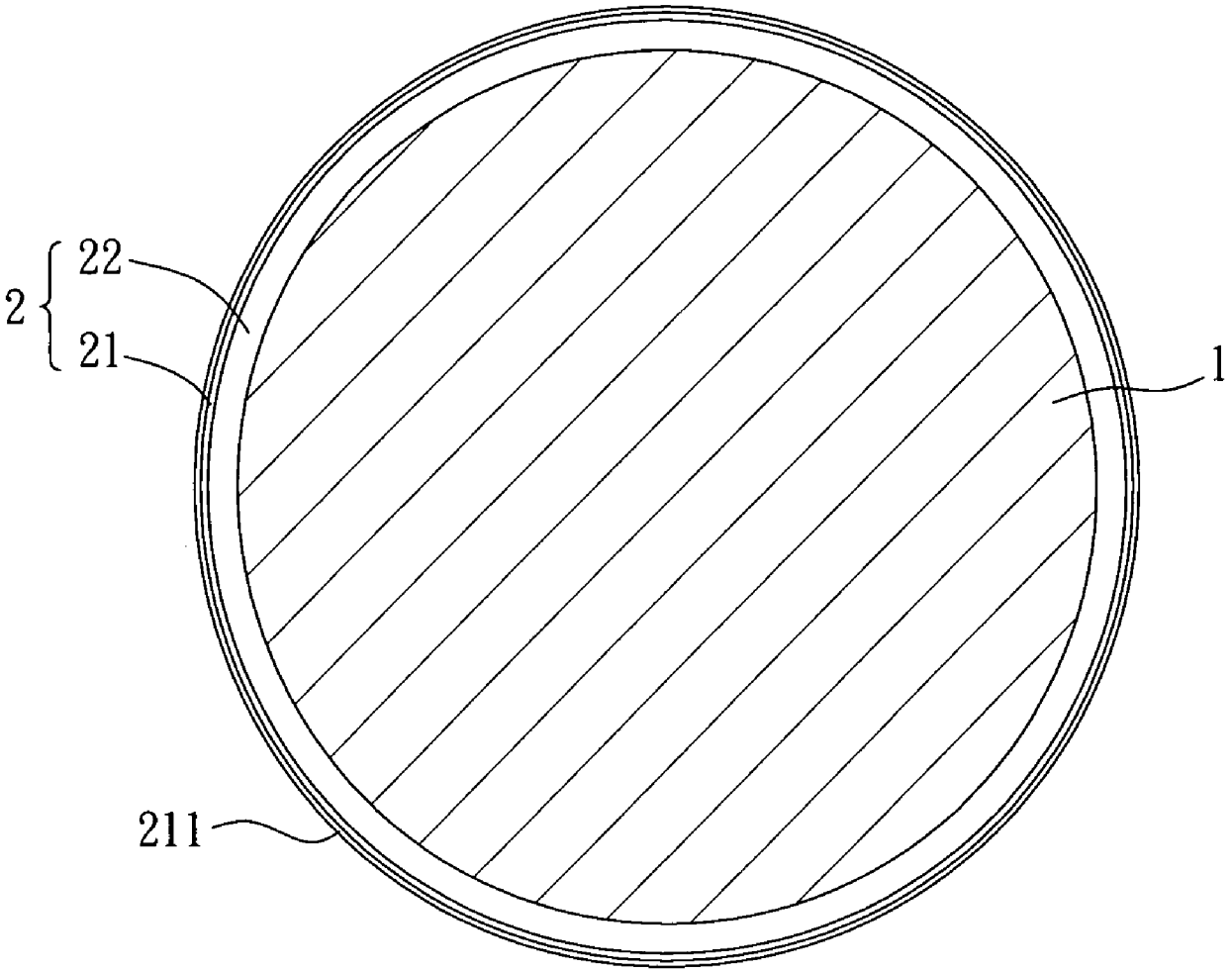
FIG. 9 is a cross sectional view of FIG. 2 along line A-A.
Figure 10:
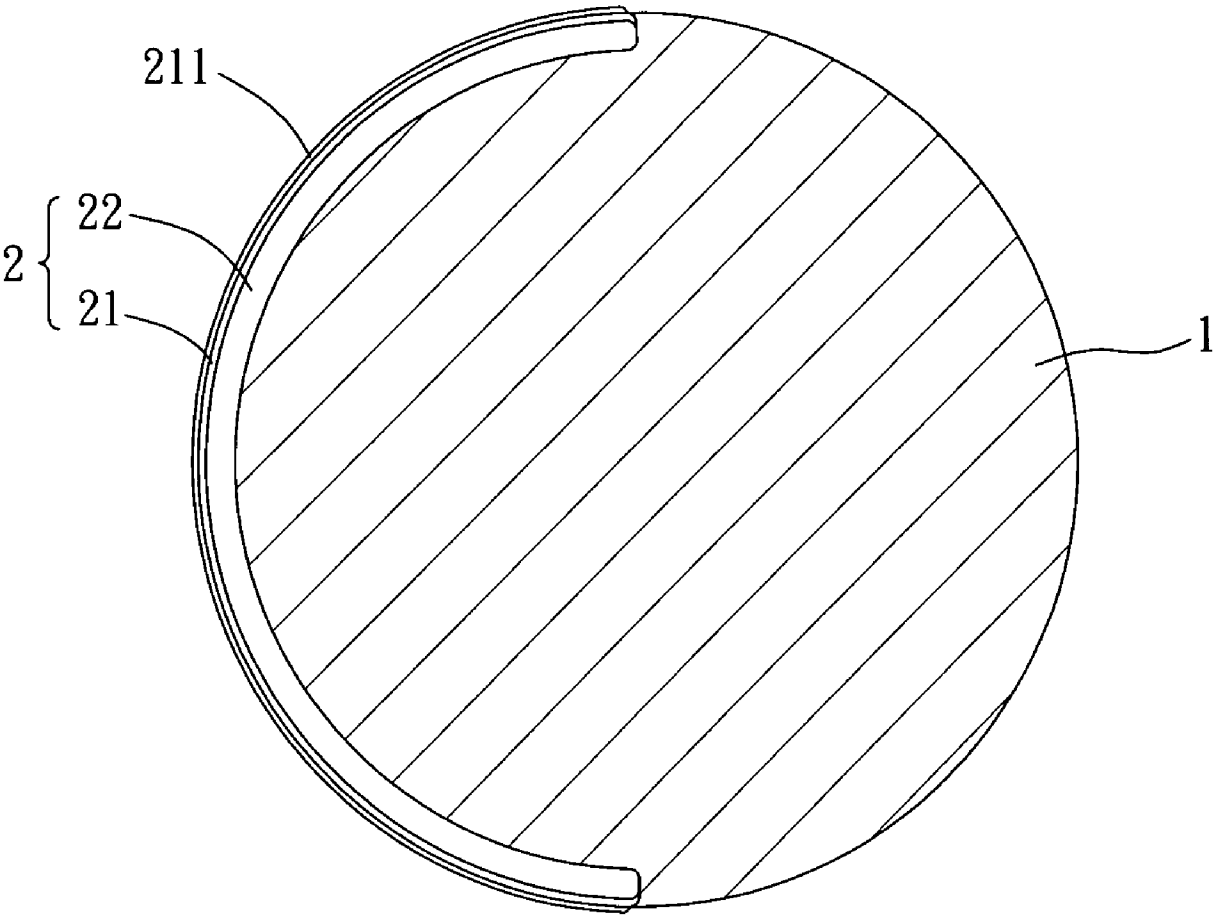
FIG. 10 is a cross sectional view of FIG. 4 along line A-A.
Figure 11:
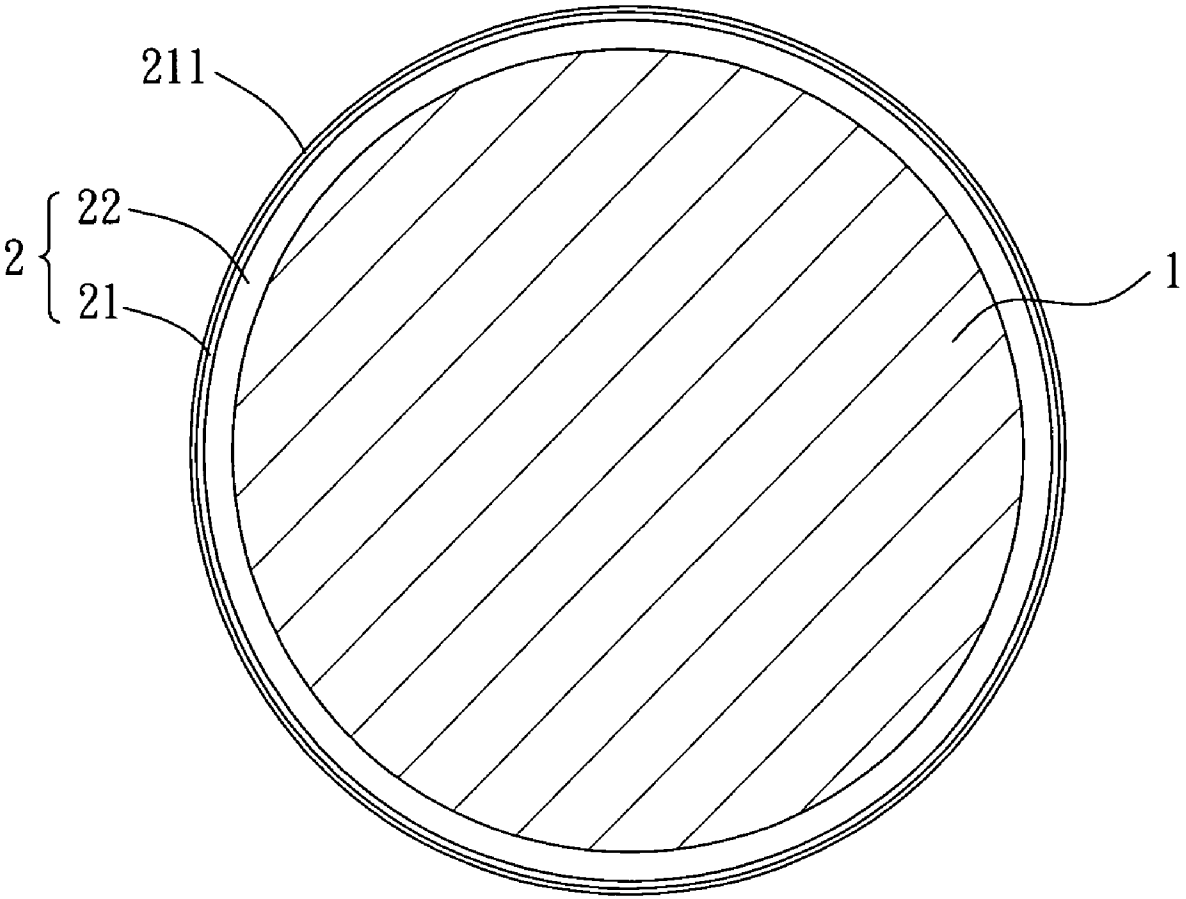
FIG. 11 is a cross sectional view of FIG. 5 along line A-A.
Figure 12:
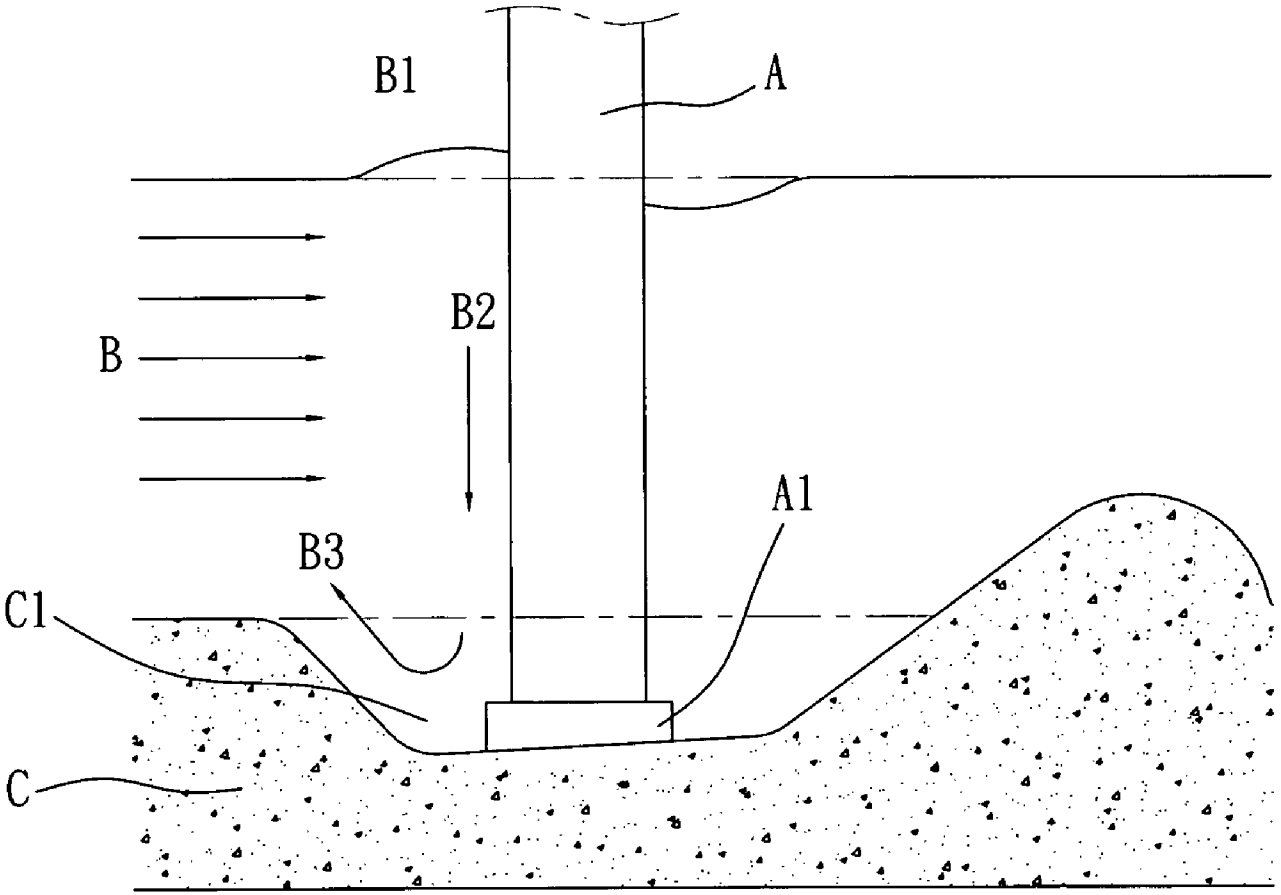
FIG. 12 is a schematic view showing a generally used pier is scoured by water flow.

As shown in FIGS. 4-6, in addition, an attracting angel 24 is formed in the pier 1 and/or the caisson 11. The attracting angel 24 is located above a corresponding space of collar 23. As shown by the flow direction D in FIG. 5, the recess portion 24 can guide the downflow B2 into the space of collar 23, and then the hook 21 guides the downflow B2 to move upwardly. As a result, the river bed is protected from being scoured.

Figure 3:
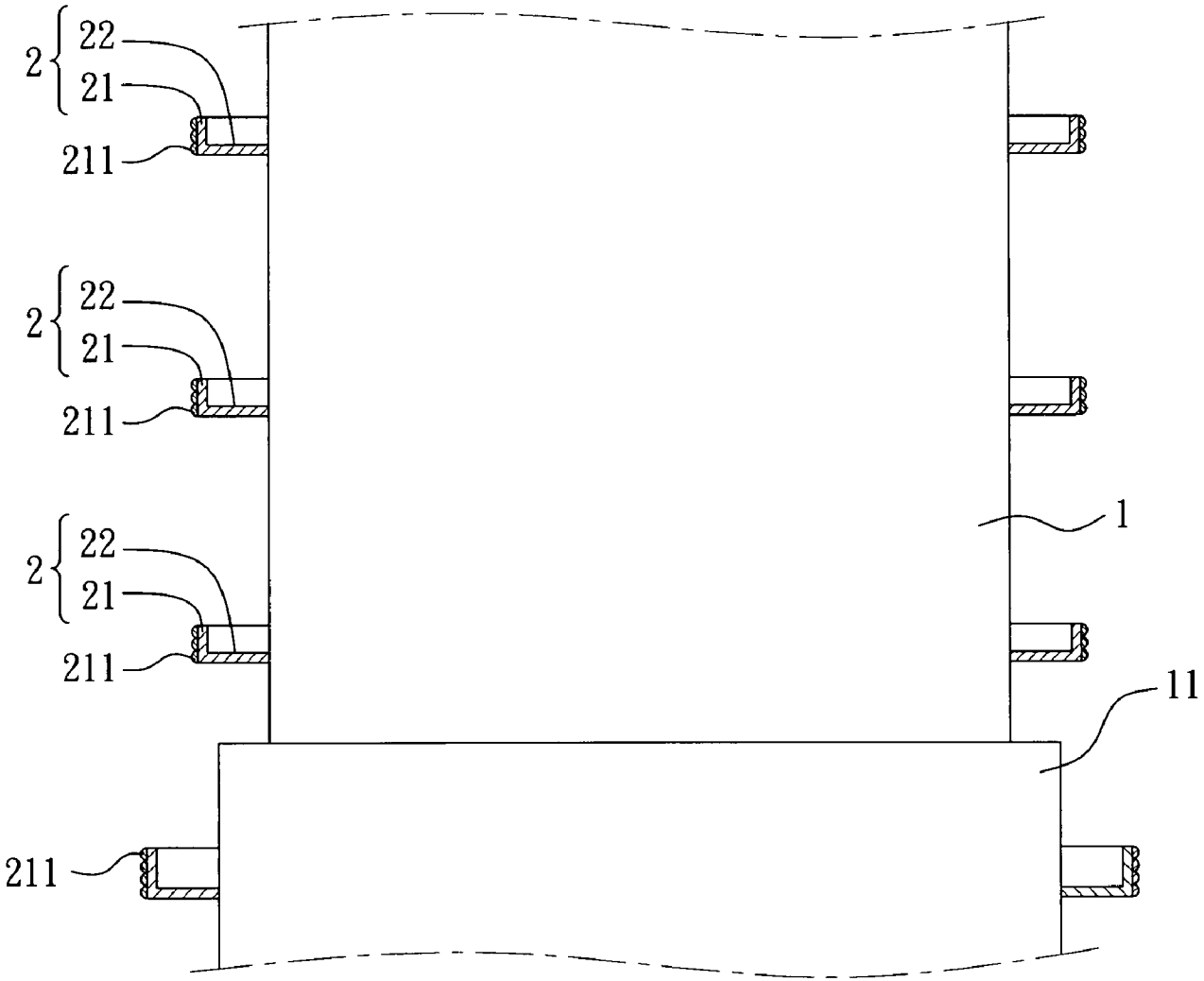
FIG. 3 is a side view of a hooked collar of the first embodiment in a multilayer manner.

As shown in FIGS. 3 and 6, one or more hooked collars 2 can be formed on the pier 1 or the caisson 11 of a bridge. An amount of the hooked collars 2 can be changed to obtain optimum anti-scour result. Specifically, the amount of the hooked collars 2 increases with the increasing of water flow B.

In the first embodiment (referring to FIGS. 1, 2, 8 and 9), the hooked collar 2 is raised from the pier 11 and the caisson 11, therefore, there are two methods to form the hooked collar 2. In the first method, the hooked collar 2 can be integrally formed with the pier 1; in the second method, the pier 1 and the hooked collar 2 are respectively manufactured and then assembled together. The second method is especially suitable for forming hooked collar on existing bridges to protect old bridges.

A width of the hooked collar 2 is not limited. If the requirement of guiding the downflow B2 is met, the width is adequate. However, it is to be understood that if the width of the space of collar is too large, a strength and shock resistance of the hooked collar 2 will be decreased and the cost is very high.

In order to clearly explain the hooked collar 2, a scale of the hooked collar 2 is increased in FIGS. 8~11.

Furthermore, a spiral on hook 211 can be formed on outside surface of the hook 21. The spiral on hook 211 can guide the water flow B at the outside surface of the hook 21 to two opposite sides of the pier 1, and prevent the water flow B to produce a downflow.

As illustrated above, the present hooked collar 2 can effectively guide water flow to move upwardly, and protect river bed from being scoured and the caisson from being uncovered. Therefore, security of the bridges take uses of such anti-structure 2 is improved and people's life and carried wealth can be protected.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A bridge, comprising:

a pier, and a hooked collar at least formed on an upstream surface of the pier, wherein the hooked collar comprises at least one hook extending from the upstream surface at a certain distance and then bending to extend upwardly thereby defining a space of collar around the pier, the hooked collar being configured for guiding water flow or downflow in the space of collar to move upwardly thereby protecting a river bed from being scoured, wherein a spiral on hook is formed on an outside surface of the hook.

2. The bridge as claimed in claim 1, wherein the space of collar is to extend peripherally from the pier.

3. The bridge as claimed in claim 1, wherein the space of collar is recessed into the pier.

4. The bridge as claimed in claim 1, wherein an attracting angel is formed in the pier, and the attracting angel is located above the space of collar.

5. A hooked collar for a pier, comprising:

a hook at least formed on an upstream surface of the pier, wherein the hook directly extends from the pier and bends to extend upwardly thereby defining a space of collar around the pier, wherein a spiral on hook is formed on an outside surface of the hook.

6. A hooked collar for a pier, comprising:

a space of collar recessed into the pier, and a hook extending from an upstream surface of the pier and then bending to extend upwardly, wherein the hook is disposed at a periphery boundary of the space of collar or close to an upper portion of the space of collar, wherein a spiral on hook is formed on an outside surface of the hook.

7. The hooked collar for pier as claimed in claim 6, wherein an attracting angel is formed above the space of collar.

8. The hooked collar for pier as claimed in claim 6, wherein the outer portion of hook is aligned with the outer surface of the pier.

9. The hooked collar for pier as claimed in claim 6, wherein the bottom of the hook is to be perpendicular to the outer surface of the pier.

* * * * *